US009279227B2

(12) United States Patent
West

(10) Patent No.: US 9,279,227 B2
(45) Date of Patent: Mar. 8, 2016

(54) FOUNDATION PIER SYSTEM

(71) Applicant: J. Stephen West, Kansas City, MO (US)

(72) Inventor: J. Stephen West, Kansas City, MO (US)

( * ) Notice: Subject to any disclaimer, the term of this patent is extended or adjusted under 35 U.S.C. 154(b) by 0 days.

(21) Appl. No.: 14/170,235

(22) Filed: Jan. 31, 2014

(65) Prior Publication Data

US 2015/0218771 A1 Aug. 6, 2015

(51) Int. Cl.

| | |
|---|---|
| ***E02D 5/54*** | (2006.01) |
| ***E02D 5/22*** | (2006.01) |
| ***E02D 35/00*** | (2006.01) |
| ***E02D 27/48*** | (2006.01) |

(52) U.S. Cl.

CPC *E02D 5/54* (2013.01); *E02D 5/223* (2013.01); *E02D 27/48* (2013.01); *E02D 35/00* (2013.01)

(58) Field of Classification Search

CPC ..... E02D 35/00; E02D 27/48; E02D 37/00; E02D 5/56; E02D 27/34; E02D 7/02; E02D 7/20; E02D 13/04; E02D 5/223; E02D 5/54; E04H 12/2215

USPC ..... 405/229, 230, 231, 232, 244; 248/73, 248/633

See application file for complete search history.

(56) References Cited

U.S. PATENT DOCUMENTS

| | | | | |
|---|---|---|---|---|
| 3,902,326 | A | 9/1975 | Langenbach, Jr. | |
| 5,116,355 | A | 5/1992 | Freeman, III | |
| 5,120,163 | A | 6/1992 | Holdeman et al. | |
| 5,171,107 | A | 12/1992 | Hamilton et al. | |
| 5,213,448 | A | 5/1993 | Seider et al. | |
| 5,234,287 | A | 8/1993 | Rippe, Jr. | |
| 5,800,094 | A | 9/1998 | Jones | |
| 5,980,162 | A * | 11/1999 | McCown | 405/244 |
| 6,074,133 | A * | 6/2000 | Kelsey | 405/244 |
| 6,079,905 | A | 6/2000 | Ruiz et al. | |
| 6,142,710 | A | 11/2000 | Holland, Jr. et al. | |
| 6,183,167 | B1 | 2/2001 | Ruiz et al. | |
| 6,206,615 | B1 * | 3/2001 | Adsb.o slashed.ll | 405/230 |
| 6,514,012 | B2 | 2/2003 | Gregory et al. | |
| 6,539,685 | B2 * | 4/2003 | Bell et al. | 52/741.15 |
| 6,676,335 | B1 | 1/2004 | Hickman | |
| 6,872,031 | B2 | 3/2005 | May | |
| 7,044,686 | B2 | 5/2006 | May | |
| 7,165,915 | B2 | 1/2007 | Queen | |

(Continued)

OTHER PUBLICATIONS

2011 Perma Jack—Foundation Repairs, Perma Jack Repairing Foundations Since 1974, www.permajack.com, downloaded Jan. 27, 2014, 2 pages.

*Primary Examiner* — David Bagnell
*Assistant Examiner* — Carib Oquendo
(74) *Attorney, Agent, or Firm* — Erickson Kernell Derusseau & Kleypas, LLC

(57) ABSTRACT

A foundation-piering system for lifting and supporting a foundation or structure. The system provides a bracket that includes a seat plate and a pier guide. The seat plate extends horizontally below the foundation to engage the bottom surface thereof. A pad is disposed between the seat plate and the foundation to resist lateral movement of the bracket when under load. The pier guide is provided at a non-vertical angle to enable driving a pier from an initial position laterally adjacent to the foundation to a position that is vertically below the foundation. To install the bracket a face is formed along a bottom edge of the foundation and at an angle corresponding to the angle of the pier guide. The pier guide is abutted against the face when installed to minimize rotational forces encountered by the bracket. The bracket requires no fasteners or other coupling with the foundation.

8 Claims, 4 Drawing Sheets

(56) References Cited

U.S. PATENT DOCUMENTS

| | | | |
|---|---|---|---|
| 7,470,090 | B2 | 12/2008 | Heppner |
| 7,607,865 | B2 | 10/2009 | Gregory et al. |
| 8,480,335 | B1 | 7/2013 | Hunter |
| 2002/0176749 | A1 | 11/2002 | Provost |
| 2007/0065232 | A1 | 3/2007 | Faries et al. |
| 2008/0014028 | A1 | 1/2008 | Faires et al. |
| 2010/0143048 | A1 | 6/2010 | Lin |
| 2010/0226725 | A1 | 9/2010 | Kaufman |

* cited by examiner

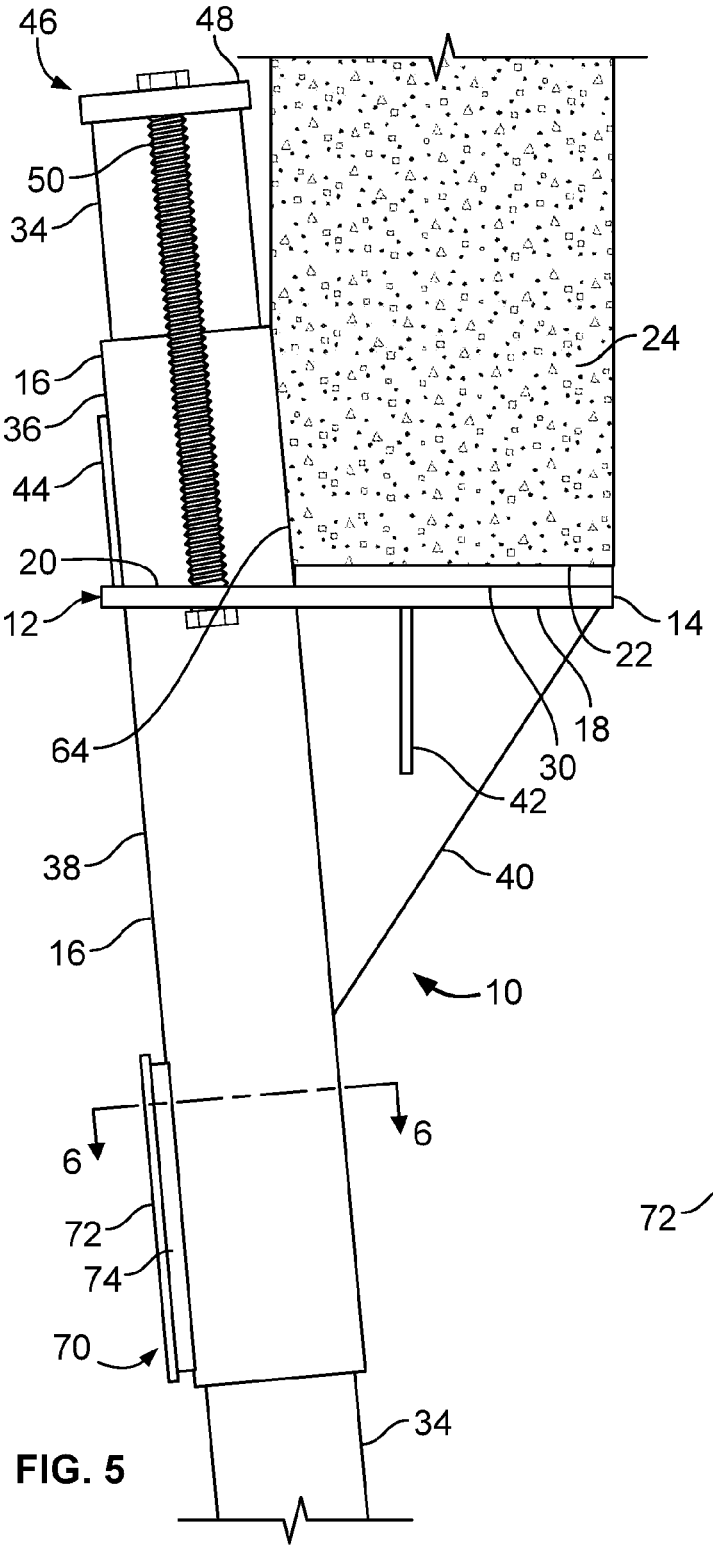
FIG. 5
FIG. 6
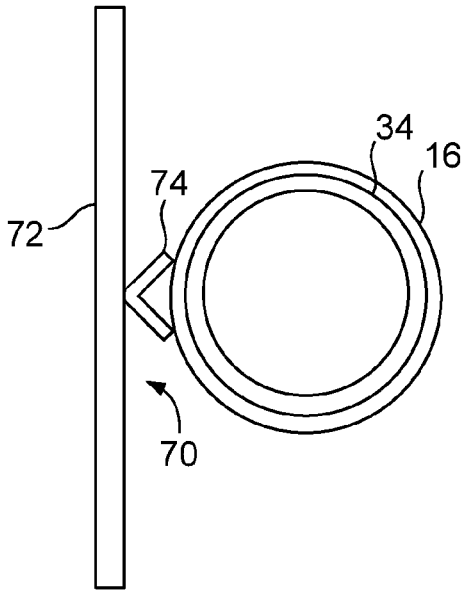

FOUNDATION PIER SYSTEM

BACKGROUND

Sinking or falling of foundations of building structures are a common problem. Resulting movements of the foundation can result in substantial structural damage to the building including cracks in walls, misalignment of doorjambs and window frames, and bulging walls among others. The sinking is generally a result of the underlying substrate having insufficient strength or stability to support the foundation. The substrate may be of a type or form that is inherently weak, such as silt, sands, or organic materials, or the substrate may be weakened as a result of natural occurrences like unusually high or low rainfall or freeze-thaw effects. Non-natural activities, such as nearby construction activities, digging, or blasting, among others might also weaken the substrate.

Typically, hydraulic lifts or jacks are employed to lift the foundation and insert a series of support posts or piers beneath the foundation. The piers are preferably driven through the substrate to contact an underlying stratum, e.g. bedrock that is of sufficient strength to support the foundation. The piers are commonly constructed of steel pipes, tubes, or beams or of concrete pre-forms. Or holes can be dug or augered beneath the foundation and concrete or similar materials poured or injected therein to form piers.

Available apparatus for lifting the foundation and installing the piers thereunder employ a bracket that is coupled to a bottom edge of the foundation or associated footing by a plurality of fasteners driven through the bracket and into the foundation. The bracket may provide a guide for driving the pier vertically downward generally parallel to a wall of the foundation and spaced a short distance outwardly away therefrom.

Known configurations create a large rotational force about the interface between the bracket and the foundation due to the lever arm formed by the spacing of the pier away from the foundation wall. The rotational force may tend to rotate or bend the bracket and may cause the pier to bend or bow under load. As a result, the bracket and the upper portion of the pier located above the bracket may rotate toward the wall of the foundation and create difficulties in operation of hydraulic units coupled thereto as well as for insertion of additional pier segments into the bracket during installation thereof.

A foundation-piering system that reduces the rotational forces encountered by the bracket is needed. A foundation-pier bracket that does not require attachment to the foundation would also be advantageous. And a foundation-piering system that provides an operating location for pier-driving apparatus that is spaced away from the foundation and that is easily adjustable after completion of a foundation leveling is needed.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter. In brief, this disclosure describes, among other things, a foundation-piering system and method useable to install support piers beneath a foundation of a structure to lift and retain the foundation in a level condition.

The foundation-piering system comprises a bracket that includes a seat plate configured to engage a bottom edge of a foundation to be raised/supported and a pier guide for guiding a pier that is driven into the underlying strata. The seat plate includes a pad disposed between the seat plate and the bottom surface of the foundation to maintain engagement of the bracket with the foundation without the use of fasteners. The pier guide is provided in a non-vertical orientation and is configured to abut or nearly abut the foundation when the bracket is engaged therewith. The bracket also includes an adjustable cross-plate that overlies an upper end of an installed pier and is coupled to the bracket via a pair of adjustment rods that are useable to adjust the distance between the cross-plate and the bracket.

DESCRIPTION OF THE DRAWINGS

Illustrative embodiments of the invention are described in detail below with reference to the attached drawing figures, and wherein:

FIG. 5 is a side elevational schematic view of a foundation-piering system with an anti-rotation plate installed thereon in accordance with an embodiment of the invention; and FIG. 6 is a cross-sectional view of the foundation-piering system of FIG. 5 taken along the line 6-6 depicted in accordance with an embodiment of the invention.

DETAILED DESCRIPTION

Figure 1:
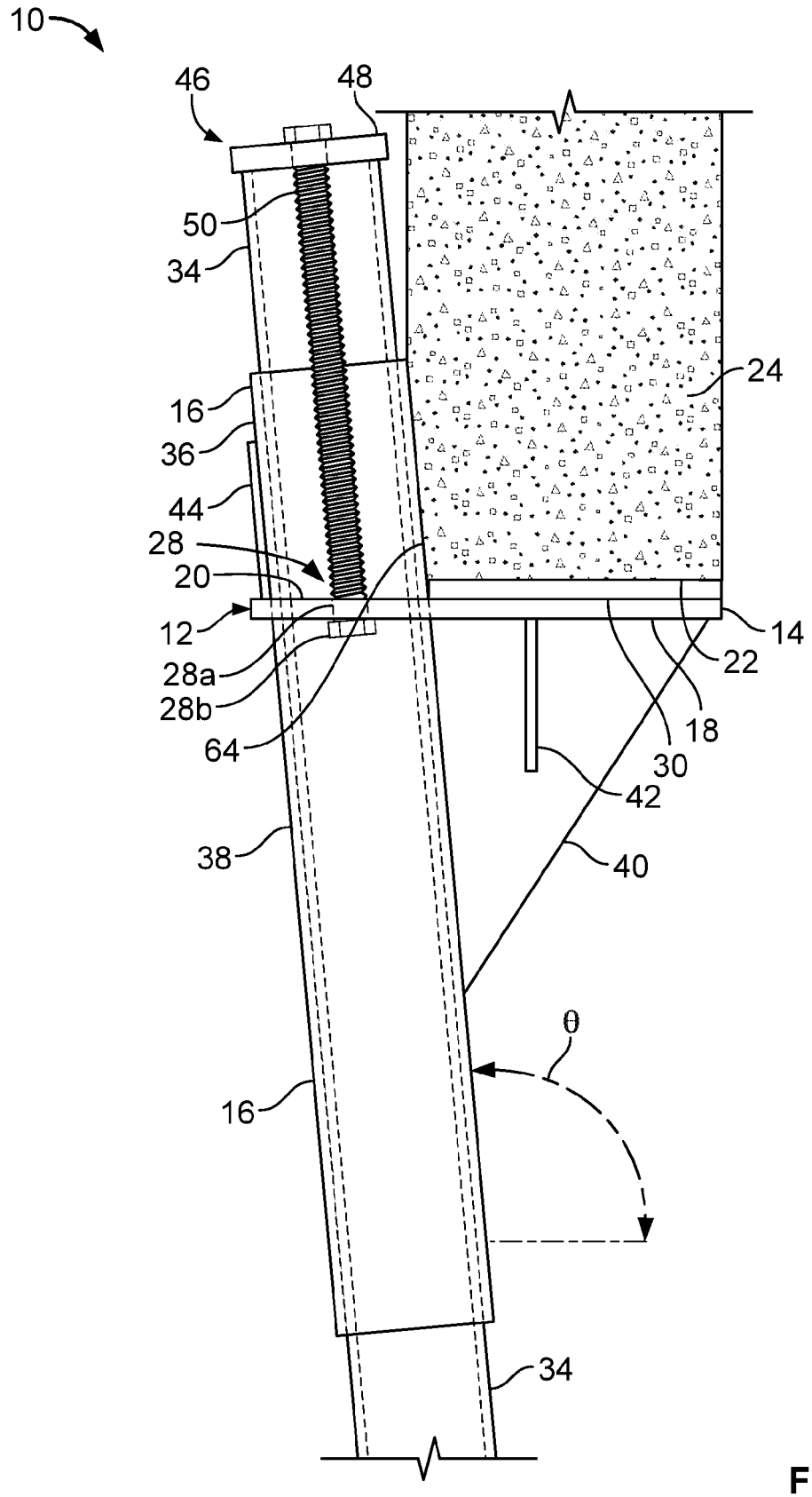
FIG. 1 is a side elevational schematic view of a foundation-piering system depicted in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

With reference now to FIGS. 1-4, a foundation-piering system 10 is described in accordance with an embodiment of the invention. The foundation-piering system 10 is describe herein with respect to repair of a concrete foundation of an overlying structure, such as a house or residential structure that requires lifting or raising to return the foundation to a desired level orientation. However, such is not intended to limit embodiments of the invention to any particular foundation or structure type, e.g. concrete, wood, residential, or commercial, among other variations. The foundation-piering system 10 might also be employed to preemptively install support piers to a foundation that does not yet require raising or leveling.

The foundation-piering system 10 comprises a bracket 12 that includes a seat plate 14 and a pier guide 16. The bracket 12 is preferably constructed from one or more steel alloys of suitable gauge and properties to support the loads and conditions applied thereto, but other materials can be employed without departing from embodiments of the invention described herein. The seat plate 14 comprises a horizontally oriented plate that includes an engagement portion 18 and a driving portion 20. The engagement portion 18 extends a sufficient distance to engage a bottom surface 22 of a foundation 24 to be raised/supported. As described herein, the foundation 24 is understood to include any footings or other elements associated with an underlying support structure for an overlying structure. The driving portion 20 provides gripping locations 26 for engagement by a pier driving apparatus (not shown), an aperture in which the pier guide 16 is secured, and a pair of threaded apertures 28 that flank the pier guide 16.

Figure 3:
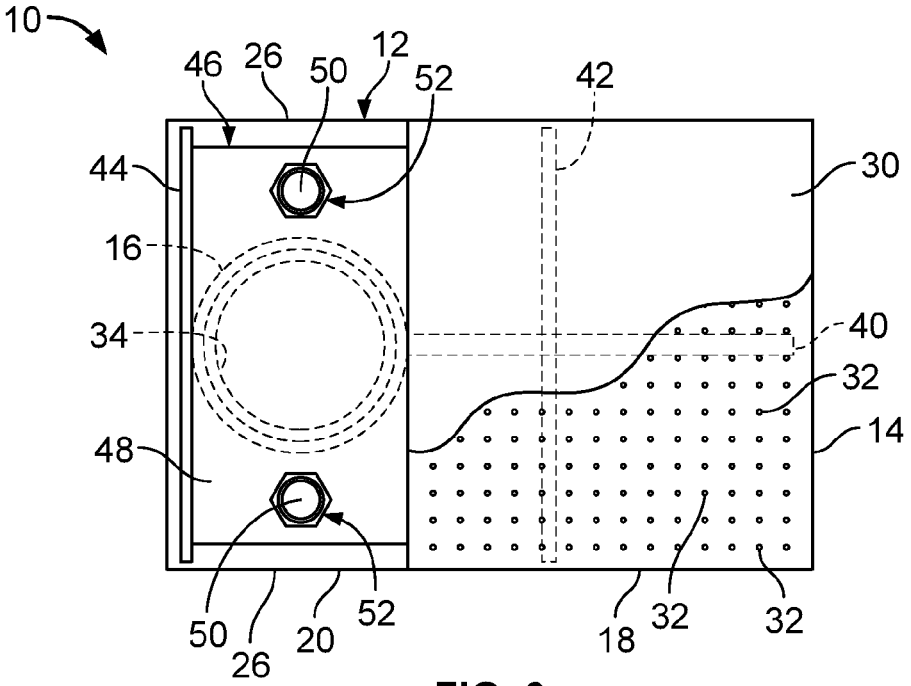
FIG. 3 is a top plan view of a bracket of the foundation-piering system of FIG. 1 with a retaining and adjusting apparatus installed thereon in accordance with an embodiment of the invention.

A pad 30 may be disposed on the upper surface of the engagement portion 18 of the seat plate 14. The pad 30 comprises a rubber, neoprene, plastic, or similar material that provides a non-slip engagement between the seat plate 14 and the bottom surface 22 of the foundation 24. The pad 30 may be at least partially resilient such that the pad 30 can conform to the bottom surface 22 but sufficiently rigid so as not to be destroyed when placed under loads associated with lifting/supporting the foundation 24. As depicted in FIG. 3, an upper surface of the engagement portion 18 of the seat plate 14 may be roughened and/or include a plurality of surface features 32 thereon to facilitate gripping of the pad 30. The surface features 32 can be dimples, studs, bumps, grooves, or ridges, among a variety of other features to which the pad 30 may at least partially conform or receive. In another embodiment, the pad 30 includes one or more apertures or blind recesses (not shown) configured to receive corresponding surface features 32, such as studs, extending from the surface of the engagement portion 18. Or the pad 30 can include one or more protuberances on a bottom surface thereof that engage corresponding apertures or recesses in the top surface of the engagement portion 18.

The pier guide 16 comprises a cylindrical tube that extends through the driving portion 20 of the seat plate 14 and has interior dimensions configured to receive a pier 34 that is driven coaxially therethrough. The pier 34 is formed from a plurality of sections of pipe or tube connected end-to-end, as described more fully below. The pier guide 16 and the pier 34 are described herein as comprising cylindrical tubes or pipes but may take other forms without departing from the scope of embodiments of the invention described herein. For example, the pier guide 16 might take the form of a square or polygonal tube while the pier 34 might be a solid bar, structural beam, e.g. an I-beam, or a tube of corresponding cross-sectional form to that of the pier guide 16, among others. In one embodiment, the pier 34 comprises a plurality of preformed sections of concrete connected end-to-end.

The pier guide 16 is disposed at an obtuse angle θ with respect to the engagement portion 18 of the seat plate 14 or at an angle (θ-90° with respect to vertical. The angle θ is between about 90° and about 100°, or preferably between about 90° and about 97°, or more preferably between about 92° and about 95°. The pier guide 16 includes an upper section 36 and a lower section 38 that extend from respective sides of the seat plate 14. The lower section 38 is generally greater than about three times the length of the upper section 36 but other dimensions can be employed. The length of the lower section 38 and/or the overall length of the pier guide 16 preferably facilitate guiding of the pier 34 into the underlying strata without substantial bending or bowing of the pier 34.

The bracket 12 includes a major gusset 40 disposed between the seat plate 14 and the lower section 38 of the pier guide 16 as well as one or more minor gussets 42 to reinforce the bracket 12. The extended length of the lower section 38 of the pier guide 16 enables increased length of the major gusset 40 and thus increased strength or reinforcement to be provided thereby. A support flange 44 is also provided between the seat plate 14 and the upper portion 36 of the pier guide 16 to reinforce the pier guide 16 against relative movements thereof.

The gripping locations 26 on the driving portion 20 of the seat plate 14 lie along opposing edges of the driving portion 20, but other locations can be employed. The gripping locations 26 provide sufficient area to accommodate jaws, clamps, or similar features of a driving apparatus (not shown) to engage the bracket 12 and to pull thereagainst while driving the pier 34 through the bracket 12 and into the subsurface. The gripping locations 26 may be reinforced or provided with additional features, e.g. apertures, ridges, or the like to aid engagement with the driving apparatus.

The threaded apertures 28 enable coupling of a retaining and adjusting apparatus 46 for retaining the pier 34 in position after driving into the subsurface. The apparatus 46 includes a cross-plate 48 and a pair of adjustment rods 50. The cross-plate 48 is generally of the same dimensions as the driving portion 20 of the seat plate 14 and includes a pair of apertures 52 that align with the threaded apertures 28 in the seat plate 14. The adjustment rods 50 are threaded along their length and include a head, e.g. a bolt head, that is engageable by a wrench, socket, or similar apparatus for rotating the rods 50. In an embodiment, the adjustment rods 50 comprise ¾ inch diameter grade 8B allthread rod and the head comprises a nut that is welded to the end of the adjustment rod 50, however other sizes and grades of material or configurations of the components (e.g. a bolt might be substituted for the welded rod and nut combination) may be employed. The rods 50 are inserted through the apertures 52 in the cross-plate 48 to engage the threaded apertures 28.

Figure 2:
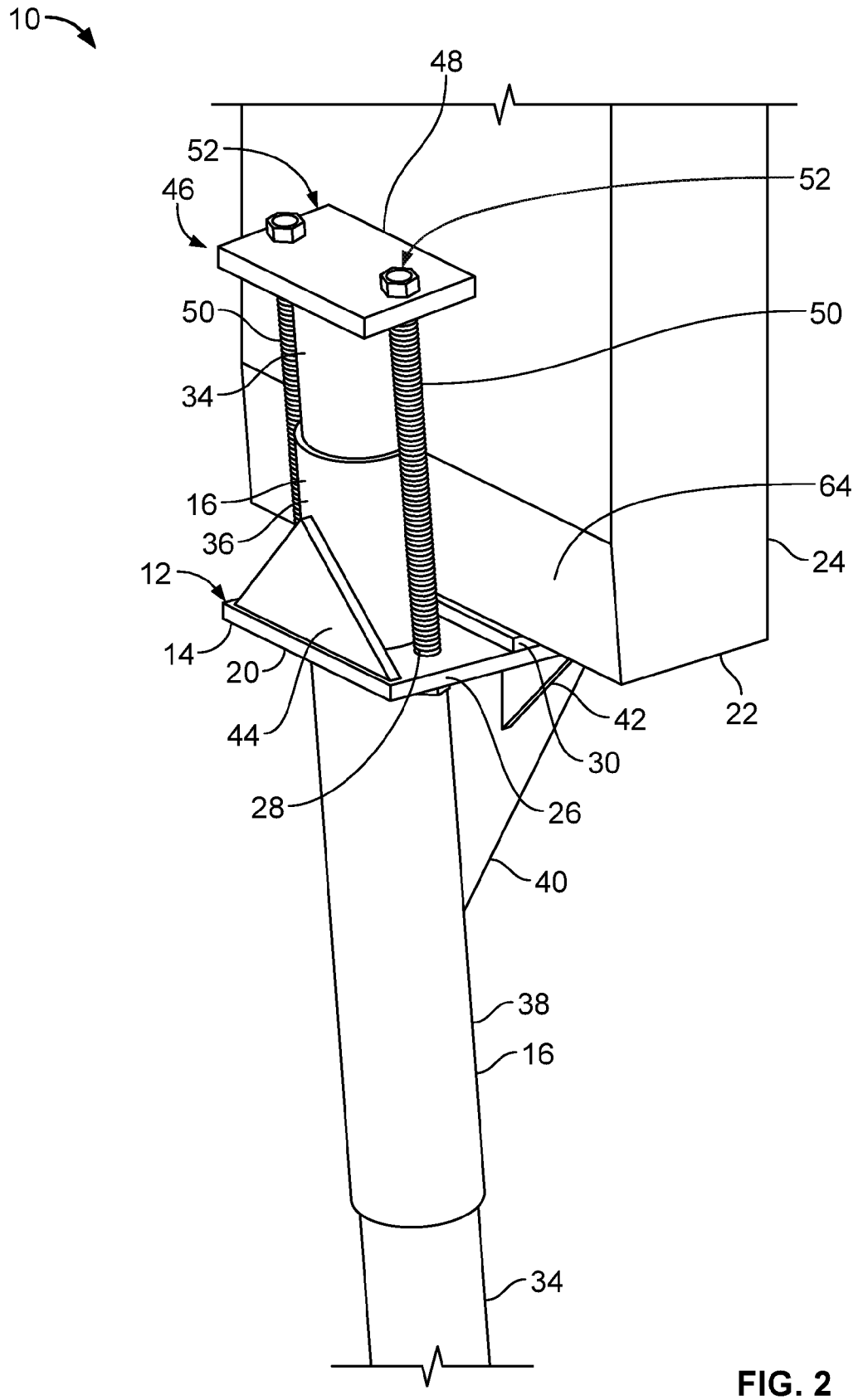
FIG. 2 is a perspective view of the foundation-piering system of FIG. 1.

As depicted in FIGS. 1 and 2, the threaded apertures 28 comprise a bore 28*a* through the seat plate 14 and a threaded nut 28*b* welded to the underside of the seat plate 14 and aligned with the bore 28*a*, but other configurations can be employed in embodiments of the invention without departing from the scope described herein. For example, the bore 28*a* might be threaded and the nut 28*b* omitted.

Rotation of the adjustment rods 50 draws the cross-plate 48 toward the seat plate 14 to abut a free end of the installed pier 34, as described more fully below. Although the apertures 28 and adjustment rods 50 are described herein as being threaded, other configurations can be employed without departing from the scope of embodiments of the invention.

Figure 4:
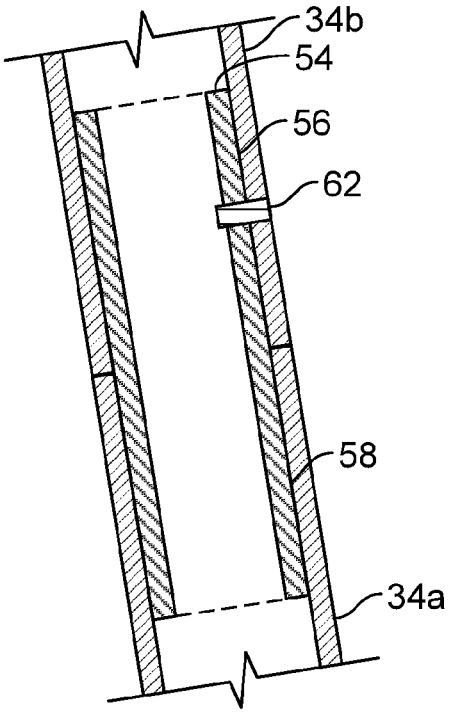
FIG. 4 is a cross-sectional elevational view of a pier coupler coupling two piers together in accordance with an embodiment of the invention.

As depicted in FIG. 4, the pier 34 comprises a plurality of tubular sections that are coupled end-to-end by a pier coupler 54. The pier coupler 54 includes an upper part 56 and a lower part 58. The pier coupler 54 is a tube or solid component that is dimensioned for receipt of the lower part 58 by an underlying pier section 34*a* and of the upper part 56 by an overlying pier section 34*b*, as shown in FIG. 4. The upper and lower parts 56, 58 preferably fit snugly within the pier sections 34*a*, 34*b* such that the pier sections 34*a*, 34*b* are retained inline, e.g. do not move laterally relative to one another or bend about the pier coupler 54 during driving of the pier 34. Adjacent ends of the pier sections 34*a*, 34*b* abut. The coupler 54 can be retained in the pier sections 34*a*, 34*b* by friction fit, or in one embodiment, a pin 62 or similar component can be inserted through an aperture 66 in the sidewall of one or both of the pier sections 34*a*, 34*b* and through an aligned aperture 68 in the sidewall of the respective upper or lower part 56, 58 of the pier coupler 54 to prevent withdrawal of the coupler 54 from the pier sections 34*a*, 34*b*.

As shown in FIG. 5, the pin 62 comprises a length of solid rod that is at least partially flattened or smashed adjacent a first end thereof, such as by striking with a hammer or clamping in a vice to cause the sides of the pin 62 adjacent to the first end to at least partially bulge outwardly in two generally diametrically opposed directions and generally parallel to the flattened surfaces thereof. An opposite second end of the pin 62 is dimensioned for receipt into the apertures 66 and 68. As such, the second end of the pin 62 can be freely inserted into the apertures 66, 68 while the sides of the pin 62 adjacent the bulging first end at least partially impede full insertion of the pin 62 into the apertures 66, 68. The first end of the pin 62 can be hammered or otherwise forced into the apertures 66, 68 until generally flush with the exterior of the pier 34 to provide a tight friction-fit to retain the pin 62 in position. The pin 62 can be further secured in the apertures 66, 68 by welding or application of one or more adhesives, glues, or the like. In another embodiment, the pin 62 might be retained by threaded coupling or welding, among other methods.

With continued reference to FIGS. 1-4, operation and installation of the foundation-piering system 10 is described in accordance with an embodiment of the invention. Although, installation of a single bracket 12 and pier 34 is described herein, it is understood that a typical application requires installation of a plurality of brackets 12 and piers 34 at spaced apart locations along the perimeter of the foundation 24. Brackets 12 and piers 34 might also be installed at locations internal to, e.g. centrally away from the perimeter of the foundation 24.

The foundation-piering system 10 can be installed inside and/or outside of the foundation 24 or structure. For example, the system 10 can be installed on a residential structure from outside the structure or through a basement floor or slab within the structure. Initially, the bottom surface of the foundation 24 at a desired installation location is exposed, such as by digging or removing the surrounding soil or by removing a portion of a concrete floor in a basement. Sufficient space for the bracket 12 is also excavated beneath the foundation 24. In an embodiment, the surrounding soil is excavated to a depth sufficient to receive the entire bracket 12 in position beneath the foundation 24 except for the portion of the lower section 38 of the pier guide 16 that extends beyond the lower apex of the major gusset 40. An auger or similar excavation tool is employed to auger or drill a hole in the appropriate position in the surrounding soil to receive the extended portion of the lower section 38. The augered hole is preferably of approximately the same diameter as the pier guide 16 so as to receive the pier guide 16 therein and to provide undisturbed soil around the pier guide 16 for additional support against rotation of the bracket 12.

A bottom edge of the foundation 24 is prepared by cutting, chiseling, hammering, or otherwise removing a portion of the foundation 24 and/or a footing forming a part thereof to provide a face 64 that is sloped at approximately the angle θ and has a length that is approximately equal to or less than that of the upper section 36 of the pier guide 16. The face 64 is depicted in the drawings as being generally planar, but in practice the face 64 may be more rough or jagged as a result of the methods employed to cut or chip the foundation 24 and the nature or makeup of the concrete forming the foundation 24. The bracket 12 is positioned with the engagement portion 18 of the seat plate 14 disposed below and in contact with the bottom surface 22 of the foundation 24 and with the upper section 36 of the pier guide 16 abutting or in very near proximity to the face 64. A first pier section 34*a* is inserted through the pier guide 16 to contact the underlying subsurface and the pier driving apparatus is coupled to the bracket 12.

The pier driving apparatus comprises available apparatus and preferably employs one or more hydraulic actuators to drive the pier 34 into the subsurface. The pier driving apparatus engages the bracket 12 at the gripping locations 26 and engages a free end of the pier 34. Actuation of the driving apparatus drives the free end of the pier 34 toward the bracket 12 to drive the opposite end of the pier 34 into the subsurface. The pier 34 is driven a distance defined by one or more of the length of the section of pier 34*a* or the available stroke of the driving apparatus. The free end of the pier 34 may be driven flush or nearly flush with the distal end of the upper section 36 of the pier guide 16.

The driving apparatus is then disengaged from the driven pier section 34*a*. A pier coupler 54 is installed in the free end of the pier section 34*a* and a second pier section 34*b* is installed on the coupler 54. The driving apparatus is engaged with the second pier section 34*b* and the driving process repeated until the pier 34 reaches a solid stratum and the foundation is raised to a desired level.

Once the foundation 24 has been raised to a desired level, the driving apparatus is disengaged from the driven pier 34 and the bracket 12 and the retaining and adjusting apparatus 46 is installed. If necessary, the free end of the pier 34 can be cut to reduce the length thereof extending from the upper section 36 of the pier guide 16 prior to installation of the retaining and adjusting apparatus 46. The cross-plate 48 is disposed to overlie the free end of the pier 34. The adjustment rods 50 are inserted through the apertures 52 in the cross-plate 48 and threaded into the threaded apertures 28 in the driving portion 20 of the seat plate 14. The adjustment rods 50 are rotated to draw the cross-plate 48 into contact with the free end of the pier 34 to resist upward movement of the pier 34. The retaining and adjusting apparatus 46 also enables subsequent adjustments to the foundation-piering system 10 that may be necessary to due further settling or lifting of the foundation 24, by further rotation of the adjustment rods 50 to move the cross-plate 48 to a desired position.

The removed soil can be replaced to cover the foundation-piering system 10 and return the area around the foundation to its original state. Similarly, when installed beneath a concrete floor or slab, the floor can be repaired or replaced to cover the foundation-piering system 10.

Driving the pier 34 into the subsurface generates an opposite reaction force between the seat plate 14 and the bottom surface 22 of the foundation 24. The reaction force engages the seat plate 14 with the pad 30 and the pad 30 with the bottom surface 22 of the foundation 24 to retain the bracket 12 in the installed position on the foundation 24.

By orienting the pier guide 34 at the angle θ and abutting the pier guide 16 against the cut face 64 formed on the foundation 24, the pier guide 16 lies at least partially beneath the foundation 24 and guides the pier 34 toward a location underlying the foundation 24. This configuration aids to maximize a vertical component of the reaction force which aids to retain the bracket 12 in the installed position on the foundation 24 while also minimizing the horizontal or shear component of the reaction force that might urge the bracket 12 to move or slide laterally away from the foundation 24. Application of the reaction force to the pad 30 may also cause the pad 30 to at least partially conform to the surface features 32 on the seat plate 14 and the bottom surface 22 of the foundation 24 to resist relative sliding movement of the bracket 12 with respect to the foundation 24. As such, the bracket 12 can be installed without the use of fasteners or other attachment means between the bracket 12 and the foundation 24.

The position of the pier guide 34 abutting the face 64 also minimizes the length of the lever arm formed between the pier 34 (e.g. the reaction force) and the interface between the bracket 12 and the foundation 24. Minimizing the length of the lever arm minimizes the rotational forces encountered by the bracket 12 that tend to cause the bracket 12 to rotate about its interface with the foundation 24. Thus, the bias on the bracket 12 to rotate about the interface with the foundation 24 (e.g. rotation of the seat plate 14 downward and away from the bottom surface 22 of the foundation 24 or of the upper section 36 of the pier guide 16 toward the foundation 24) is minimized.

Providing the pier guide 16 at the angle θ also increases the available area for location and operation of the driving apparatus. By orienting the pier guide 16 at the angle θ the upper section 36 leans away from the wall of the foundation 24 and thus any apparatus coupled thereto and the sections of the pier 34 inserted therein also lean away from the foundation 24. As such, the driving apparatus and an operator thereof are not obstructed by the foundation 24 during driving of the pier 34. And the overall vertical height of the driving apparatus and the sections of pier 34 extending from the pier guide 16 are also reduced due to their angled orientation; the foundation-piering system 10 can thus be employed in more tightly confined spaces than known systems.

Additionally, the angle θ of the pier guide 16 enables driving the end of the pier 34 to a position vertically beneath the foundation 24 from a driving position located alongside the foundation 24. In contrast, by prior methods, driving a pier to a position vertically beneath a foundation require additional excavation under the foundation to enable driving the pier from an initial location that is vertically below the foundation.

With reference now to FIGS. 5 and 6, the foundation-piering system 10 may be provided with an anti-rotation plate 70. The anti-rotation plate 70 is configured to provide additional resistance to rotation of the bracket 12 about the interface between the bracket 12 and the foundation 24. The anti-rotation plate 70 might be used to provide additional support for the foundation-piering system 10 when supporting larger structures or greater loads or when soil conditions are suboptimal.

The anti-rotation plate 70 comprises an obstructing plate 72 with an alignment member 74 coupled thereto and extending along at least a portion of the height of the obstructing plate 72. The obstructing plate 72 is preferably a generally rectangular steel plate having a width that is substantially greater than the diameter of the pier guide 34 but other shapes and dimensions may be employed. A lower or leading edge of the obstructing plate 72 may have a wedged shape to aid cutting through the surrounding soil as described below.

The alignment member 74 is disposed generally centrally on a face of the obstructing plate 72 and has a form configured to accept or engage an outer surface of the pier guide 16 to resist relative lateral movements between the anti-rotation plate 70 and the pier guide 16. The alignment member 74 preferably comprises a section of angle iron, e.g. a structural steel component having a cross-sectional shape with a pair of flanges oriented at right angles to one another, but other forms can be used. For example, the alignment member 74 might have an arcuate form mimicking that of the pier guide 16 or might comprise a pair of spaced apart, parallel flanges extending from the surface of the plate 72.

Installation of the anti-rotation plate 70 is preferably completed after the bracket 12 is disposed beneath the foundation 24 with the lower section 38 of the pier guide 16 inserted into an augered hole. The alignment member 74 is placed parallel to and in contact with the lower section 38 of the pier guide 16 and along a side thereof that is opposite the foundation 24 and the engagement portion 18 of the seat plate 14. The width of the obstructing plate 72 is thereby positioned generally parallel to width of the seat plate 14 and the foundation 24. The anti-rotation plate 70 is driven downwardly into the surrounding soil, such as by hammering along a top edge thereof. As the anti-rotation plate 70 is driven through the soil, the alignment member 74 slides along and follows the pier guide 16 to maintain a desired alignment of the obstructing plate 72 with the pier guide 16. The wedge shape of the leading edge of the obstructing plate 72 may also aid to direct the plate 72 toward the pier guide 16 to maintain engagement between the pier guide 16 and the alignment member 74. The anti-rotation plate 70 is preferably driven to a depth generally equal to that of a lower end of the pier guide 16. In another embodiment, the anti-rotation plate 70 may be coupled to the pier guide 16, such as by welding, and installed as an integral part of the bracket 12.

The anti-rotation plate 70 thus provides a broad surface area perpendicular to a direction of rotation of the bracket 12 to provide additional resistance to such rotation. The location of the anti-rotation plate 70 adjacent the lower end of the pier guide 16 also provides a large lever arm between the obstructing plate 72 and the interface between the bracket 12 and the foundation 24 to further enhance the resistance to rotation provided by the anti-rotation plate 70.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A foundation-piering system comprising:

a bracket that includes a seat plate and a pier guide, the seat plate being configured for substantially horizontal placement beneath a bottom surface of a foundation in an installed position, and the pier guide being disposed at an obtuse angle relative to the seat plate; and an anti-rotation plate disposed adjacent a lower end of the pier guide, the anti-rotation plate including an obstructing plate having a width that is substantially greater than a diameter of the pier guide and an alignment member disposed generally centrally along the width of the plate and extending parallel to the pier guide, an outer surface of the pier guide being at least partially engaged by the alignment member to resist relative lateral movements between the anti-rotation plate and the pier guide.

2. The foundation-piering system of claim 1, further comprising:

a pad disposed on the seat plate and between the seat plate and the bottom surface of the foundation when in the installed position, the pad resisting relative lateral movements between the bracket and the foundation.

3. The foundation-piering system of claim 2, wherein the seat plate includes one or more surface features and the pad at least partially conforms to the surface features on the seat plate and to the bottom surface of the foundation when under load.

4. The foundation-piering system of claim 1, wherein in the installed position, at least a portion of the pier guide abuts the foundation.

5. The foundation-piering system of claim 4, wherein the portion of the pier guide abutting the foundation abuts a face formed on the foundation, the face being oriented at an angle substantially corresponding to the obtuse angle of the pier guide.

6. The foundation-piering system of claim 1, wherein at least a portion of the pier guide is vertically beneath the foundation in the installed position.

7. The foundation-piering system of claim 1, wherein the obtuse angle is between about 92° and about 95.

8. The foundation-piering system of claim 1, further comprising:

a pier inserted in the pier guide and at least partially driven into an underlying surface, the pier including a first section and a second section coupled end-to-end;

a coupler disposed in adjacent ends of the first section and the section of the pier; and a pin having a cylindrical body and a first end that is deformed to cause the body to bulge radially outward in two diametrically opposed directions, the pin being inserted into a first aperture in one of the first or second pier sections and a corresponding second aperture in the coupler, the first end of the pin providing a friction fit of the pin in one or both of the first and second apertures.

* * * * *